US005704817A

United States Patent [19]

Vaughn

[11] Patent Number: 5,704,817

[45] Date of Patent: Jan. 6, 1998

[54] WATER SURFACE PROPULSION DEVICE

[76] Inventor: Wayne P. Vaughn, P.O. Box 751544, Memphis, Tenn. 38175-1544

[21] Appl. No.: 633,143

[22] Filed: Apr. 16, 1996

[51] Int. Cl.[6] ..... B63H 19/00

[52] U.S. Cl. ..... 440/33; 114/242; 114/315

[58] Field of Search ..... 114/242, 315; 440/6, 33; 441/65

[56] References Cited

U.S. PATENT DOCUMENTS

| | | | |
|---|---|---|---|
| 2,722,021 | 11/1955 | Keogh-Dwyer | 9/21 |
| 3,422,785 | 1/1969 | Strumor | 114/235 |
| 3,422,787 | 1/1969 | Rush | 115/6.1 |
| 3,441,952 | 4/1969 | Strader | 115/6.1 |
| 3,442,240 | 5/1969 | Wild et al. | 114/16 |
| 3,536,025 | 10/1970 | Tierney | 115/70 |
| 3,789,792 | 2/1974 | Smith | 114/315 |
| 3,831,546 | 8/1974 | Geres | 115/6.1 |
| 4,700,654 | 10/1987 | Borges | 440/70 |
| 4,811,682 | 3/1989 | Hwang et al. | 440/6 |
| 4,840,592 | 6/1989 | Anderson | 441/65 |
| 4,864,959 | 9/1989 | Takamizawa et al. | 440/6 |
| 4,971,586 | 11/1990 | Walsh | 440/1 |
| 5,388,543 | 2/1995 | Ditchfield | 441/65 |
| 5,396,860 | 3/1995 | Cheng | 440/6 |
| 5,469,803 | 11/1995 | Gallo | 114/315 |

FOREIGN PATENT DOCUMENTS

| | | | |
|---|---|---|---|
| 1389312 | 4/1964 | France | 114/242 |
| 518819 | 3/1955 | Italy | 114/242 |

*Primary Examiner*—Jesus D. Sotelo

[57] ABSTRACT

A motorized aquatic propulsion device of the type that will tow a swimmer across a water surface. The main housing (10) contains the battery (58), motor (60) and propeller (62). Water enters the forward water intake tube (32), is forced through the inner water intake chamber (34) by the spinning propeller (62) and is expelled through tubes connected to the left water jet spout (38) and the opposing right water jet spout (42). Two handles are gripped and twisted to control maneuverability. The pivoting speed control handle (50) regulates the velocity of water passing through the device. The pivoting direction control handle (70) is used to govern the flow of water variably channeled between two water jet spouts. As more water is directed through one of the two water jet spouts, the device will turn in the opposing direction. The flow of water is expelled down and away from either side of the swimmer.

3 Claims, 4 Drawing Sheets

WATER SURFACE PROPULSION DEVICE

BACKGROUND—FIELD OF INVENTION

This invention relates to a motorized aquatic device, and more particularly, to a device that will tow a swimmer across a water surface.

BACKGROUND—DESCRIPTION OF PRIOR ART

There are many prior art references of devices used to propel a swimmer through and across water. Many allow swimmers to travel underwater while others offer the safety of continuous flotation. Because underwater diving requires special equipment and training devices designed for underwater propulsion are not suitable for the average swimmer. U.S. Pat. No. 4,864,959 to Takamizawa et al. (1989) is only one of many similar examples.

Devices cited in prior art are generally powered either by a battery operated motor or gasoline engine. Designs with gasoline engines are somewhat more complicated. Gasoline engines usually contain more working parts and are more likely to fail, should certain parts become wet. The foremost disadvantage is the additional time and added cost of maintenance. U.S. Pat. No. 3,831,546 to Geres (1974) is indicative of these types of gasoline engines which also tend to be environmentally unfriendly.

Prior art, for the most part, has dictated an external propeller with some kind of shroud to protect the swimmer from the spinning blades. A shroud will separate propeller and swimmer, but a shroud does not always protect the propeller from floating debris. It is possible for an external propeller and shroud to become an obstacle for the swimmer. U.S. Pat. Nos. 3,422,785 to Strumor (1969), 3,442,240 to Wild et al. (1969) and 3,789,792 to Smith (1974) are key examples.

U.S. Pat. No. 3,422,787 to Rush (1969) and U.S. Pat. No. 4,700,654 to Borges (1987) illustrate devices that must be strapped to a swimmer. Extra care must be taken to ensure that these types of devices are properly positioned and secured.

U.S. Pat. No. 5,388,543 to Ditchfield (1995) more closely relates to this application for patent, but fails to exhibit similar elements and characteristics. Ditchfield discloses a device that expels a single jet of water just below the torso of the swimmer. The swimmer must shift his weight from side to side in order to navigate the device.

Prior to this application for patent, very little consideration had been given to variable speed and direction controls. Previous references lack the distinction of a fully enclosed motor and propeller with the simplicity of handles for the dual function of gripping and controlling both speed and direction. None of the prior art has the same combination of functions and features. It is believed that this invention is a significant advancement over prior art.

OBJECTS AND ADVANTAGES

There are many objects and advantages of this invention. For recreation, this device can be used as a swimming aid or for other water related activities. The control handles serve the dual function of gripping the device and variably controlling both speed and direction. The swimmer has complete freedom to move about at will, whether it be on the surface of freshwater or saltwater. The device can be used in a pool, pond, stream, river, take, or ocean.

For surface transportation, the device will safely tow an individual across moderate distances of water with the assurance of continuous flotation. If used in conjunction with a raft or other equipment, lifeguards or rescue teams can transport people to shore. In case of emergency, the device can provide flotation and transportation for more than one individual. Several factors must be considered to determine the exact limitations.

Effortless maneuverability is accomplished by use of the two control handles. The swimmer travels in the water behind the device at the same relative water level. Unlike other devices, it is not likely that the swimmer will be thrown above and beyond the device.

All of the stated disadvantages of the prior art are overcome by this invention. Continuous flotation is achieved. One housing safely encloses the motor, battery, propeller and other supporting parts. The battery powered motor is quiet, easy to maintain, and less taxing on the environment than a gasoline engine. The device does not have to be attached to the swimmer. Water expelled from the device does not flow directly in the path of the swimmer.

There are therapeutic advantages associated with this invention. Provided the individual has adequate upper body strength and proper supervision, the device can be used as an aid in various types of physical therapy. A patient can exercise his or her lower body while using the device for support and flotation.

Further objects and advantages of this invention will become apparent from a consideration of the ensuing description and drawings.

DRAWINGS FIGURES

REFERENCE NUMERALS IN DRAWINGS

| | |
|---|---|
| 10 main housing | 12 housing top panel |
| 14 perimeter bumper | 16 carry handle |
| 18 battery compartment | 20 battery compartment lid |
| 22 insulation material | 30 water intake screen |
| 32 water intake tube | 34 water intake chamber |
| 36 left water output tube | 38 left water jet spout |
| 40 right water output tube | 42 right water jet spout |
| 50 pivoting speed control handle | 52 electronic control box |
| 54 control panel | 56 water sensor |
| 58 battery | 60 motor |

-continued

| | |
|---|---|
| 62 propeller | 70 pivoting direction control handle |
| 72 flow control pulley system | 74 flow control mounting pin |
| 76 water flow control flap | 90 light |
| 92 light power receptacle | 94 light power switch |
| 96 on/off switch | 98 key locked power switch |

SUMMARY OF THE INVENTION

The water surface propulsion device will tow a swimmer across a water surface. The device has a battery powered motor and a propeller that are fully enclosed in a housing designed for continuous flotation. Two handles are used for gripping the device and enable maneuverability. One handle is used to control speed and the other handle is used to control direction.

DESCRIPTION—FIGS. 1 TO 7

Figure 1:
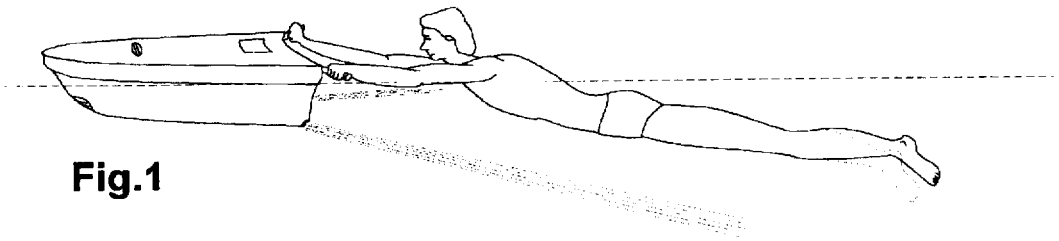
FIG. 1 is a side view of the water surface propulsion device and a person to illustrate positioning during normal operation, a horizontal dotted line to represent a typical water level while in motion, and slanted, dotted lines to depict the path of expelled water.
Figure 2:
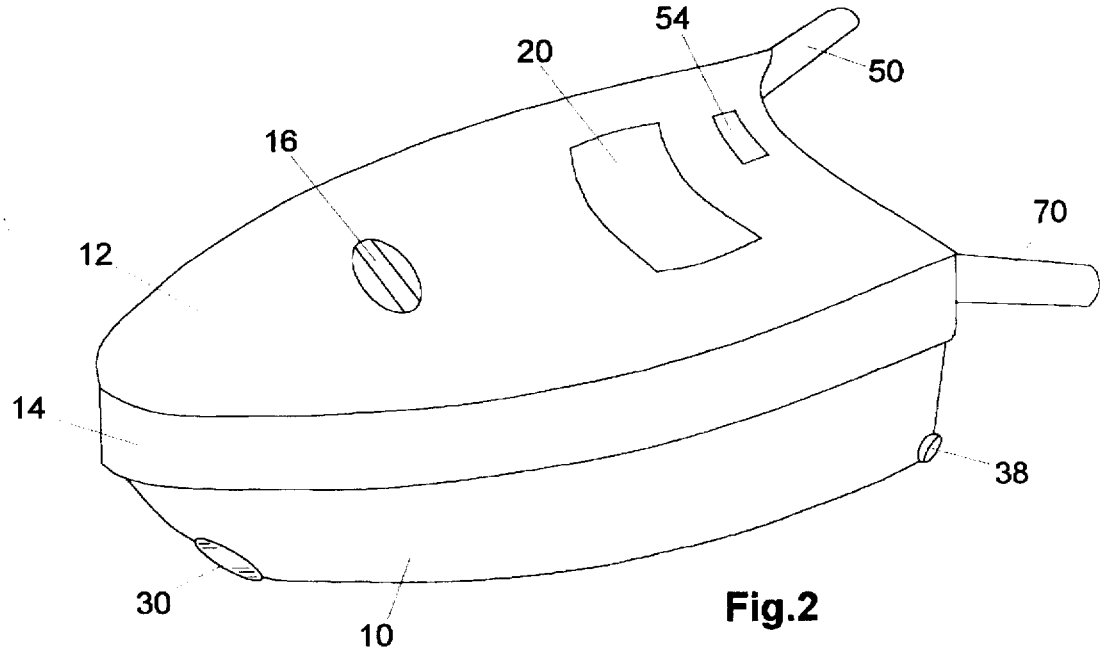
FIG. 2 is a perspective view showing the general outward features of the water surface propulsion device.

A typical embodiment of the water surface propulsion device is illustrated in FIG. 1 (side view) and FIG. 2 (perspective view). The device has a boat shaped main housing 10 constructed of fiberglass, durable plastic, or another similar material. The housing top panel 12 is made of a like material and is permanently attached to the upper edge of main housing 10 in a watertight manner. A perimeter bumper 14 formed of rubber or a rubber like material is adhered to the top edge of main housing 10. Carry handle 16 is recessed into the forward half of top panel 12 and reinforced to provide added strength. The battery compartment lid 20 is hinged to housing top panel 12 after an opening is created to accommodate the structure. Control panel 54 is attached to the back side of housing top panel 12. The pivoting speed control handle 50 is mounted to the back side of main housing 10 in the upper right corner. The pivoting direction control handle 70 is mounted to the back side of main housing 10 in the upper left corner.

Figure 3:
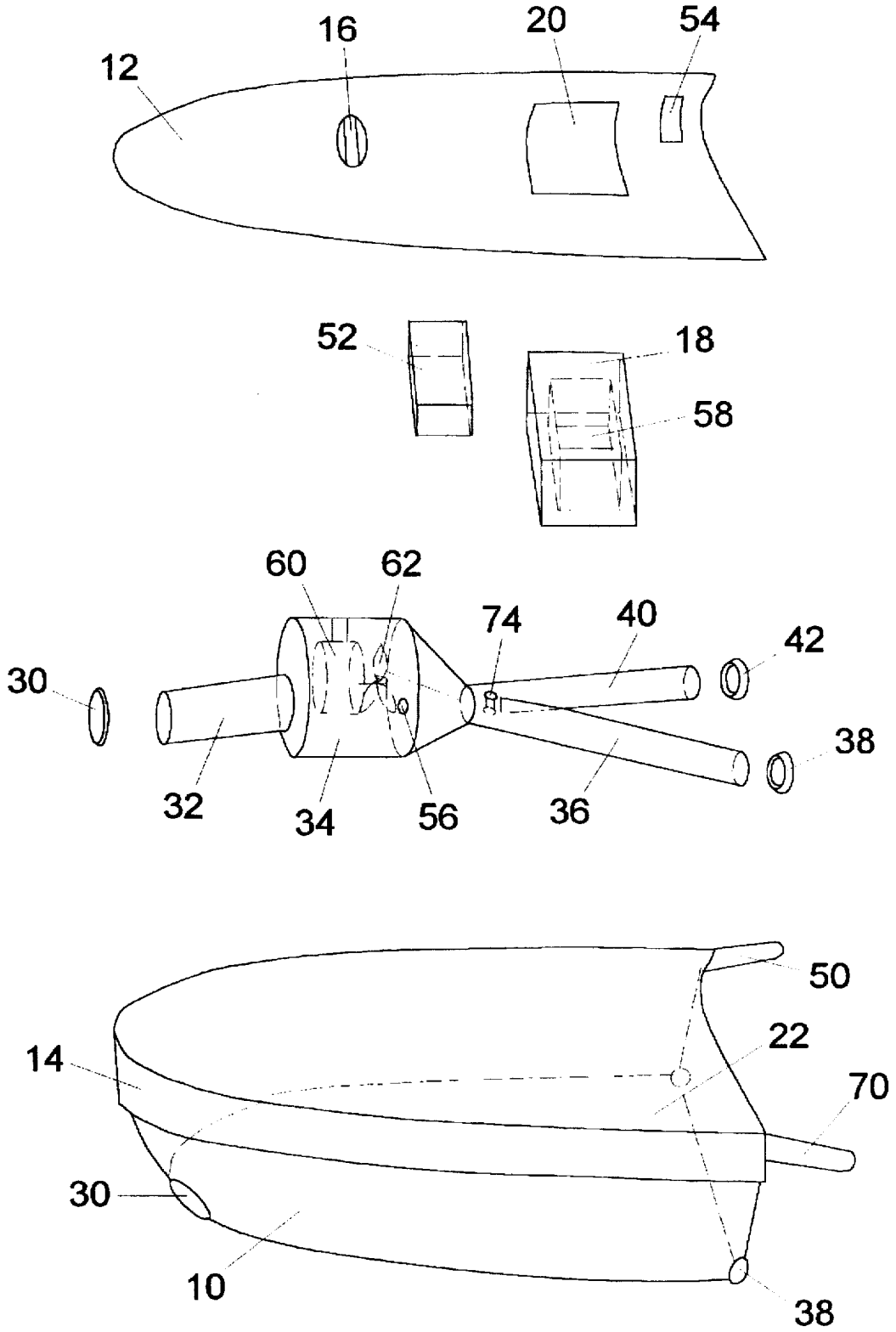
FIG. 3 is an exploded view of the water surface propulsion device.

Referring to FIG. 3 (exploded view), the battery compartment 18 is mounted to the under side of housing top panel 12 in a position which corresponds with battery compartment lid 20. The battery 58 is placed inside of the battery compartment 18. The electronic control box 52 is attached to the under side of housing top panel 12 near the battery compartment 18. The electronic control box 52 contains the components necessary to control the electronic functions of the device. Electrical leads from the pivoting speed control handle 50 and the battery 58 are routed to and from the electronic control box 52.

Water intake tube 32 is connected to the forward side of main housing 10 and sealed to prevent water from entering the interior of the device. The water intake screen 30 is secured at the point where water intake tube 32 and main housing 10 meet. One end of the water intake chamber 34 is attached to the water intake tube 32 and the other end is joined in a watertight manner to a point where the left water output tube 36 and the right water output tube 40 meet. The reverse end of the left water output tube 36 is secured to an opening on the back, left side of main housing 10 with left water jet spout 38 and sealed. The reverse end of the right water output tube 40 is secured to an opening on the back, right side of main housing 10 with right water jet spout 42 and sealed. Interior space not occupied by components is filled with a synthetic foam like insulation material 22.

A commercially obtained boat trolling motor 60 is mounted inside of the water intake chamber 34. The propeller 62 is coupled with the shaft of motor 60. A water sensor 56 is mounted to one side of the water intake chamber 34. The motor 60 and water sensor 56 are both wired to the electronic control box 52. The pivoting direction control handle 70 is attached to the flow control pulley system 72.

Figure 4:
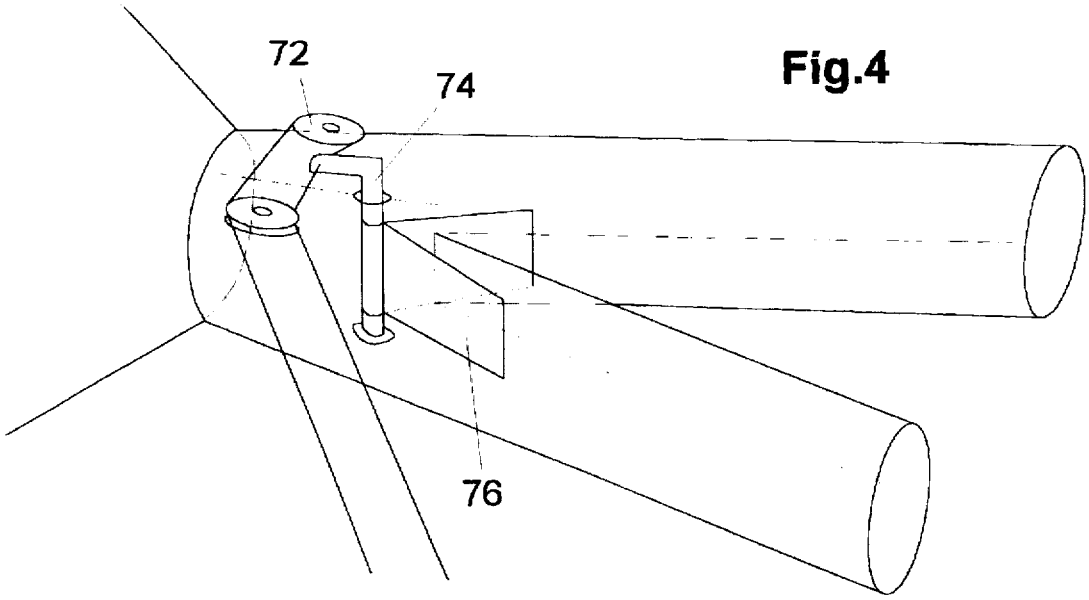
FIG. 4 is a perspective view of the water flow control assemblage located inside of the water surface propulsion device.
Figure 5:
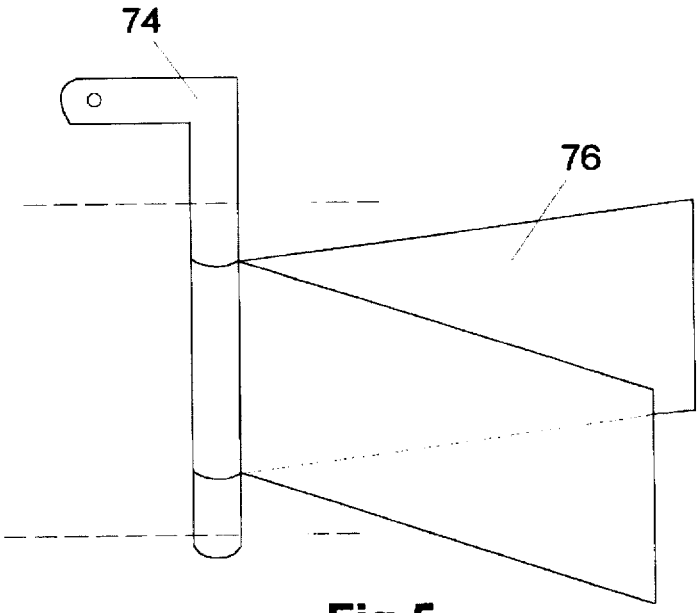
FIG. 5 is an enlarged perspective view of the water flow control flap and flow control mounting pin located inside of the water surface propulsion device.

Referring to FIG. 4, the flow control pulley system 72 is connected to the water intake chamber 34. The flow control mounting pin 74 is rotary sealed in a vertical position at a point in the water intake chamber 34 near left water output tube 36 and right water output tube 40. Water flow control flap 76 is permanently affixed to the flow control mounting pin 74. FIG. 5 further details the water flow control flap 76 and flow control mounting pin 74.

Figure 6:
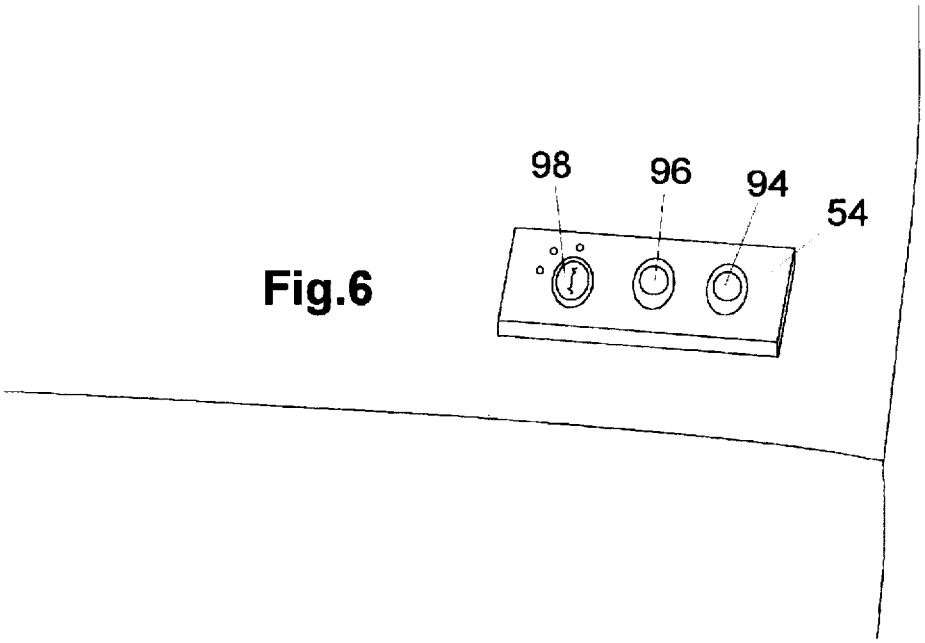
FIG. 6 is a perspective view of the control panel and an alternative array of switches located on the top surface of the water surface propulsion device.
Figure 7:
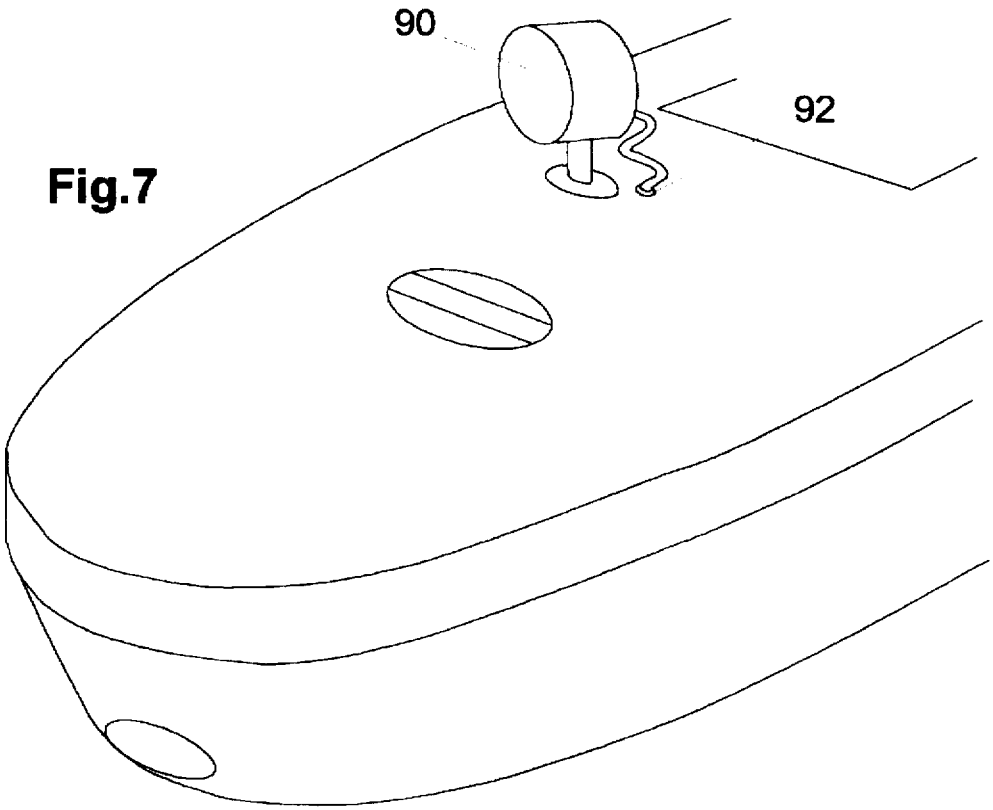
FIG. 7 is a perspective view of an alternative light mounting and light power receptacle positioned on the top surface of the water surface propulsion device.

Additional embodiments are shown in FIGS. 6 and 7. In FIG. 6, key locked power switch 98, on/off switch 96 and light power switch 94 are mounted on control panel 54. All mounted components are wired to electronic control box 52. FIG. 7 illustrates an alternative light 90 mounted to the surface of top panel 12. The power cord of light 90 is inserted into light power receptacle 92.

OPERATION—FIGS. 1 TO 7

The water surface propulsion device is simple to operate. After being lowered into a body of water, switches are set to their on and locked positions. When the control handles are gripped by the swimmer and the right speed control handle is twisted, the device is engaged. Both the device and the swimmer are propelled forward as illustrated in FIG. 1.

As shown in FIG. 2, the boat shaped main housing 10 capped by housing top panel 12 creates buoyancy by displacing water. The perimeter bumper 14 surrounds the device to cushion encounters with other objects. A carry handle 16 provides a reinforced grip for transporting the device.

Referring to FIG. 3, water enters the device through the water intake tube 32 which is protected from debris by the water intake screen 30. Water is pulled into the water intake chamber 34 by motion generated by the motor 60 and propeller 62. The water is then variably channeled by the water flow control flap 76 between the left water output tube 36 and the right water output tube 40. The position of water flow control flap 76, detailed in FIG. 5, is shifted when the flow control mounting pin 74 is turned by the flow control pulley system 72. Flow control mounting pin 74 is rotary sealed to prevent water from leaking into the interior of the main housing 10. This is more readily apparent in FIG. 4.

Continuing with FIG. 3, the left water jet spout 38 and right water jet spout 42 are tilted to direct the expelled water down and away from the swimmer at a slight angle. Insulation material 22 is used to fill the negative space within main housing 10, to cushion internal parts from vibration and to enhance buoyancy.

The pivoting direction control handle 70 manipulates the flow control pulley system 72, turns the flow control mounting pin 74, and shifts the water flow control flap 76. As the water flow control flap 76 is shifted, more water is forced through either left water output tube 36 or right water output tube 40 depending on position, provided that the motor 60 is engaged. The pivoting direction control handle 70 can be twisted in either direction to steer the device to the left or to the right. For example, if more water is forced through left water output tube 36, the device will turn to the right. The reverse is also true. Releasing tension on the pivoting direction control handle 70 will return the flap to a balanced position. When this happens, the device will continue in a forward direction.

The pivoting speed control handle 50 is used to engage the device and to regulate the speed of the motor 60. This is accomplished by twisting the pivoting speed control handle 50 in the same manner as one would twist a motorcycle handle. When tension on the pivoting speed control handle 50 is released, power to the motor 60 is disengaged and the propeller 62 will cease to turn.

The battery compartment 18 and battery compartment lid 20 provide a watertight storage location for the battery 58. The electronic control box 52 centrally houses the electronic circuitry needed to operate the motor 60, as well as, any other supporting components. The water sensor 56 will disengage the device when the water level is not adequate for operation. The battery 58, motor 60, water sensor 56, pivoting speed control handle 50 and electronic components located on control panel 54 are interconnected with shielded wire.

As illustrated in FIG. 6, the control panel 54 can support several optional components such as a key locked power switch 98 to prevent unauthorized use. If the key locked power switch 98 were to support a third position in addition to an on and an off position, the third position could be used to provide a stepped down power mode for the device. Reducing the maximum speed of the motor 60 can offer greater control and safety to younger swimmers. An on/off switch 96 can be used to quickly disconnect power to the device.

As shown in FIG. 7 as an alternative configuration, a light 90 can be mounted on the surface of housing top panel 12. A light power receptacle 92 can be provided as a convenient power source for the light 90. In this example, a light power switch 94 mounted on the control panel 54 would complete a circuit from the light 90 to the battery 58.

CONCLUSION, RAMIFICATIONS, AND SCOPE

The water surface propulsion device can tow a swimmer across a water surface with the ease of gripping and twisting two handles. A full range of maneuverability is available from one simple and convenient housing. The device is easy to use, versatile and suited for many tasks.

Anyone skilled in the art can make various modification without departing from the spirit of this invention. The description above contains many specificities which should not be construed as limiting the scope of the invention. These specificities have been provided to illustrate only some of the presently preferred embodiments of this invention. For example, the device can be constructed of numerous materials having varied size, shape and color. The inner chamber and tubes can have an alternate configuration. Ramifications can also include other mechanism for controlling speed or direction. Assorted attachments can enhance functionality, such as a mounted hook to secure a tow line and an additional compartment to store safety equipment or personal belongings.

The scope of this invention should be determined by the appended claims and their legal equivalents, rather than by the specific examples given.

I claim:

1. In an aquatic propulsion device of the type comprising a housing having sufficient buoyancy for enabling said housing to float across a water surface, a motor mounted in said housing for producing rotational energy, a battery mounted in said housing for storing and supplying power to said motor, a propeller coupled with said motor, a speed control handle, and a direction control handle, whereby said housing will be propelled across said surface, the improvement wherein said direction control handle has direction control means for causing water to be variably channeled between a plurality of tubes.

2. The device of claim 1 wherein said device has sensor means for detecting the presence of water in said housing.

3. The device of claim 1 wherein said device has key lock means for connecting said motor to said battery.

* * * * *